US007000545B2

(12) United States Patent
Sansolo

(10) Patent No.: US 7,000,545 B2
(45) Date of Patent: Feb. 21, 2006

(54) MULTIFUNCTIONAL BREACHING APPARATUS

(76) Inventor: Arie Sansolo, 19 Harel Street, Afridar, Ashkelon 78649 (IL)

( * ) Notice: Subject to any disclaimer, the term of this patent is extended or adjusted under 35 U.S.C. 154(b) by 55 days.

(21) Appl. No.: 10/773,837

(22) Filed: Feb. 9, 2004

(65) Prior Publication Data

US 2004/0200342 A1 Oct. 14, 2004

(51) Int. Cl.
*F42B 3/00* (2006.01)

(52) U.S. Cl. ..... 102/331; 102/305; 102/314; 102/275.12; 102/275.7

(58) Field of Classification Search ..... 102/301, 102/307, 309, 314, 331, 275.7, 275.12; 86/50; 89/1.14; 174/93
See application file for complete search history.

(56) References Cited

U.S. PATENT DOCUMENTS

| | | | | |
|---|---|---|---|---|
| 3,477,372 | A * | 11/1969 | Nelson et al | 102/307 |
| 3,658,006 | A * | 4/1972 | Nistler et al. | 102/307 |
| 4,821,645 | A * | 4/1989 | Reiss | 102/275.7 |
| 4,856,430 | A * | 8/1989 | Gibb et al. | 89/1.14 |
| 4,938,143 | A * | 7/1990 | Thomas et al. | 102/332 |
| 4,998,478 | A * | 3/1991 | Beck | 102/275.12 |
| 5,133,258 | A * | 7/1992 | Rock et al. | 102/331 |
| 5,824,954 | A * | 10/1998 | Biche et al. | 174/93 |
| 5,959,237 | A * | 9/1999 | Clement | 102/331 |
| 6,341,708 | B1 * | 1/2002 | Palley et al. | |

* cited by examiner

*Primary Examiner*—Michael J. Carone
*Assistant Examiner*—James S. Bergin
(74) *Attorney, Agent, or Firm*—Dekel Patent Ltd.; David Klein

(57) ABSTRACT

Breaching apparatus including a housing constructed of a material that disintegrates upon explosion without significant amounts of fragments being given off, and an explosive element disposed in the housing capable of producing an explosive force sufficient for breaching a structure.

8 Claims, 3 Drawing Sheets

MULTIFUNCTIONAL BREACHING APPARATUS

FIELD OF THE INVENTION

The present invention relates generally to breaching apparatus, that is, devices for gaining entry by explosive force.

BACKGROUND OF THE INVENTION

Special weapons and tactic (SWAT) teams or other police and military personnel may use breaching apparatus to gain entry into locked and barricaded buildings, where criminals, terrorists, hostages, drug caches and the like are located. The situations that may be encountered are so varied that usually such teams must be equipped with a large variety of equipment for overcoming a broad spectrum of problems and obstacles that must be overcome to gain entry. In addition, it is highly desirable to minimize damage to surrounding structure when using explosives to gain entry.

SUMMARY OF THE INVENTION

The present invention seeks to provide novel breaching apparatus. In accordance with an embodiment of the invention, the breaching apparatus may comprise a flexible detonating cord (or any other kind of explosive wire or cord) wound or wrapped around partitions and encased in a housing constructed of a material (e.g., a flexible polymeric material, such as polyester) that disintegrates (e.g., becomes powder) upon explosion, unlike prior art devices which are made of materials (e.g., rubber) which may break into fragments upon explosion. The partitions may prevent adjacent wrappings or windings of the detonating cord from blowing up one another. Additional layers of the detonator cord may be placed on previous layers to increase the explosive force as desired. A detonator device may be placed in line with the detonator cord for initiating the explosive force. The detonator device may be in the same plane as the detonator cord for more efficient detonation, instead of being perpendicular thereto, which is less efficient.

The housing may be constructed of two halves, which may be conveniently and easily attached to one another by a press fit, unlike prior art breaching devices that are joined together by screws. The housing may be mounted or affixed to any structure (e.g., doors or buildings) by various attachment devices, such as but not limited to, multiple hook fasteners (e.g., VELCRO), vacuum attachment devices, magnetic fasteners, double-sided adhesive, spikes and the like. The housing may further comprise a fastener for attachment to a robotic arm, for safe remote operation.

This structure may help prolong the time duration of the pushing force of the breaching apparatus while at the same time produce a controlled explosive force that may breach a door (without fragmentizing the door) and free locking bolts from their moorings, without causing undo harm to the rest of the building or nearby structures or buildings. The apparatus of the present invention may be lighter in weight than devices of the prior art.

In another embodiment of the invention, the breaching apparatus may comprise a box-like structure with hollow chambers for placing detonators therein. Again, the housing may be constructed of a material (e.g., flexible polymeric materials, such as polyester) that disintegrates upon explosion. The housing does not contain any liquid, which may cause fragments or other dangerous materials to be flown about. The hollow chambers may be positioned close to the surface of the housing that is placed and affixed to the structure to be breached (e.g., windows or shutters and the like), so that most of the explosive force is directed towards the structure being breached. The housing may be attached to a tray, adapted for holding additional explosive devices, such as but not limited to, detonating sheets. The housing may also comprise a fastener for attachment to a robotic arm, for safe remote operation.

BRIEF DESCRIPTION OF THE DRAWINGS

The present invention will be understood and appreciated more fully from the following detailed description, taken in conjunction with the drawings in which.

DETAILED DESCRIPTION OF EMBODIMENTS

Figure 1:
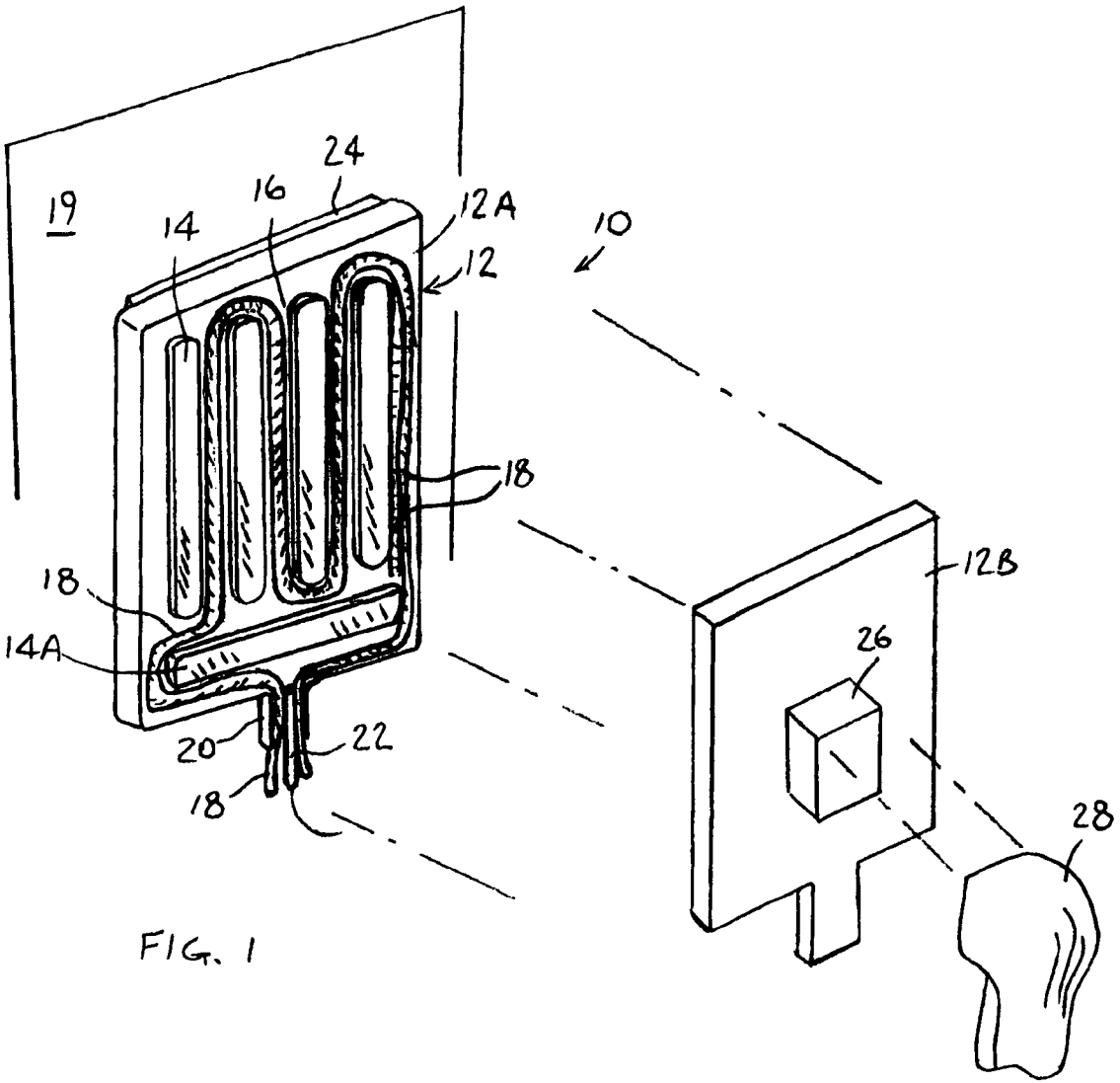
FIG. 1 is a simplified exploded illustration of breaching apparatus, constructed and operative in accordance with an embodiment of the present invention.

Reference is now made to FIG. 1, which illustrates breaching apparatus 10, constructed and operative in accordance with an embodiment of the present invention.

Breaching apparatus 10 may comprise a housing 12 constructed of a material (e.g., a flexible polymeric material, such as polyester) that disintegrates (e.g., becomes powder) upon explosion without significant amounts of fragments being given off. Housing 12 may comprise two halves 12A and 12B attached to one another by a press fit. At least one of the halves of housing 12 may further comprise internal partitions 14 spaced from one another, defining grooves 16 therebetween. In the illustrated embodiment, some of the partitions 14 are positioned parallel to one another, and another partition, designated partition 14A, is positioned perpendicular to the rest of the partitions. It is appreciated that this is only one of many possible arrangements of the partitions and the invention is not limited to this arrangement.

An explosive element 18 may be disposed in housing 12 capable of producing an explosive force sufficient for breaching a structure 19 (such as, but not limited to, a door). The explosive element 18 may be flexible, such as but not limited to, detonating cord (also referred to as demolition cord). A layer of the flexible explosive element 18 may be disposed in grooves 16 between partitions 14, and wrapped around one or more partitions 14, as seen in FIG. 1. The partitions 14 substantially prevent adjacent windings of the explosive element 18 from blowing up one another. As seen partially in FIG. 1, additional layers of the flexible explosive element 18 may be placed one above another.

Housing 12 may comprise an exit port 20 through which the ends of explosive element 18 may exit housing 12 for connection to detonators or other explosion initiators. For example, a detonator device 22 may be placed adjacent and coplanar to the explosive element 18.

Housing 12 may comprise an attachment device 24 for attachment to structure 19, which is to be breached. The attachment device 24 may comprise, without limitation, a multiple hook fastener (e.g., VELCRO), a vacuum attachment device, a magnetic fastener, a double-sided adhesive, a spike (e.g., sharp pins, nails or studs), screws or rivets.

Housing 12 may further comprise a fastener 26 for attachment to a robotic arm 28 for safe remote operation.

Figure 2:
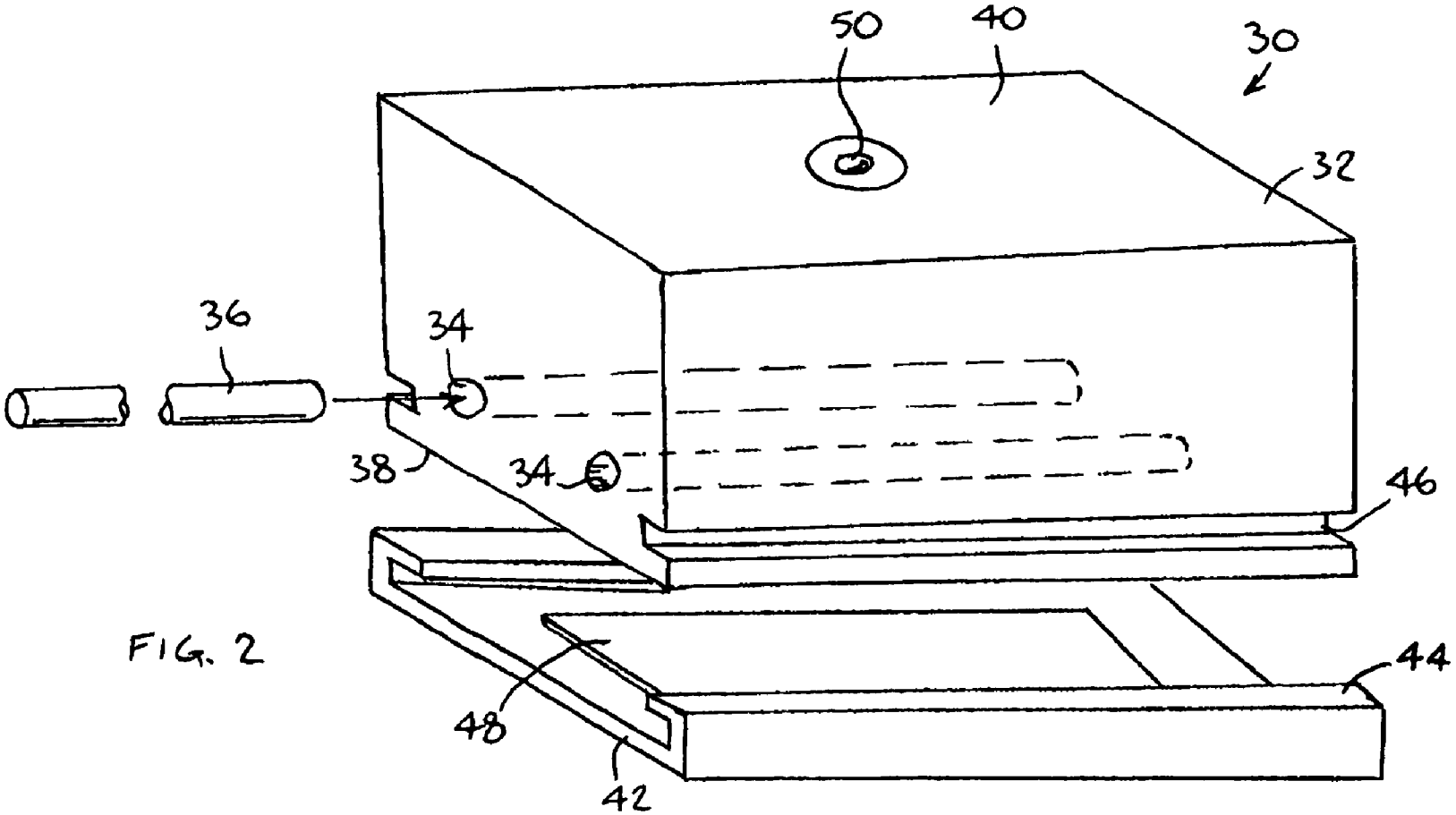
FIG. 2 is a simplified pictorial illustration of breaching apparatus, constructed and operative in accordance with another embodiment of the present invention.

Reference is now made to FIG. 2, which illustrates breaching apparatus 30, constructed and operative in accordance with an embodiment of the present invention. Breaching apparatus 30 may comprise a housing 32 which is also constructed of a material that disintegrates upon explosion without significant amounts of fragments being given off. Housing 32 may comprise a box-like structure with one or more hollow chambers 34 in which an explosive element 36 (e.g., detonator) may be disposed. The hollow chambers 34 are preferably positioned closer to a first surface 38 of housing 32 that is attachable to a structure to be breached (not shown in FIG. 2, but could be the structure 19 shown in FIG. 1, or a window or shutter, for example) than to a second surface 40 of housing 32 opposite to first surface 38. In this manner, most of the explosive force is directed towards the structure being breached.

A tray 42 may be attached to housing 32, such as by means of longitudinal tenons 44 that fit into mortises 46 formed in housing 32. An additional explosive device 48, such as but not limited to, a detonator sheet or flexible explosive sheet, may be disposed between tray 42 and housing 32. The housing may also comprise a fastener 50, such as but not limited to, a dimple-shaped depression, for attachment to a robotic arm (similar to that shown in FIG. 1), for safe remote operation.

Figure 3:
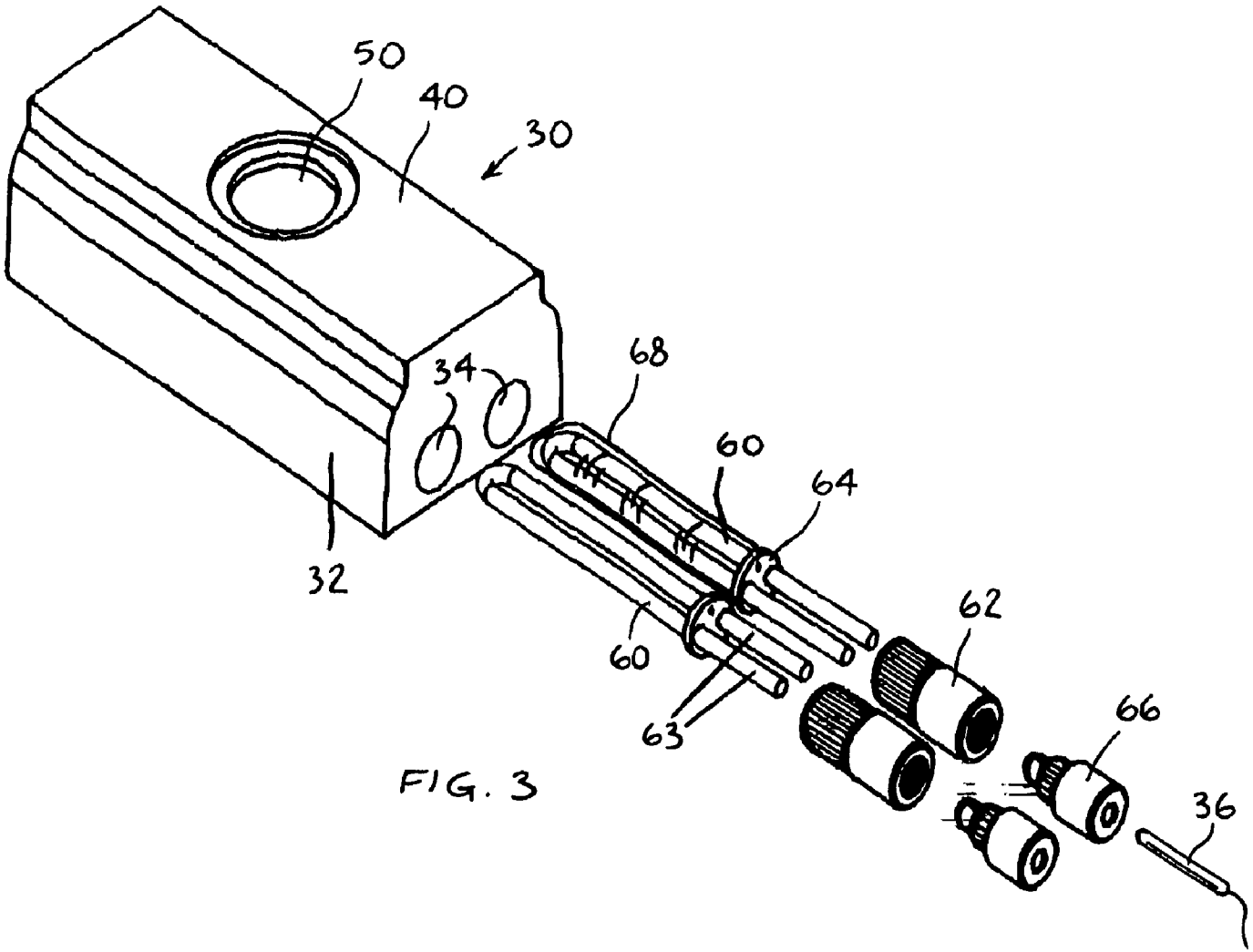
FIG. 3 is a simplified exploded illustration of breaching apparatus, constructed and operative in accordance with yet another embodiment of the present invention.

Reference is now made to FIG. 3, which illustrates another version of breaching apparatus 30, in accordance with another embodiment of the present invention. In this illustrated version, tray 42 is omitted, but it may be included if desired.

In this version of breaching apparatus 30, the explosive element placed in each hollow chamber 34 may include an elongate detonating cord 60, which may without limitation be bent in an elongate U-shape. Ends 63 of the detonating cord 60 may be operatively connected to a sleeve housing 62, which may contain therein explosion booster material or any other material that helps to accelerate the detonation of the elongate detonating cord 60. Ends 63 of the detonating cord 60 may pass through a guide element 64, which may be secured to sleeve housing 62, such as by a press fit, click fit or threaded connection, for example. A detonator housing 66 may be secured to the other side of the sleeve housing 62 (again by any suitable connection, such as by a press fit, click fit or threaded connection, for example), in which the explosive element 36 (e.g., detonator) may be disposed. The detonator housing 66 may be rotated (quarter turn or half turn or full turn, for example) to lock the explosive element 36 relative to the sleeve housing 62.

The elongate detonating cord 60 may be at least partially enveloped in a sheath 68, which may be constructed of a flexible material, such as but not limited to, polyurethane sheet. (In the illustration only one of the detonating cords 60 is shown in a sheath.) The sheath 68 may inhibit the detonation of detonating cord 60, thereby increasing the energy needed for the detonating cord 60 to explode, and increasing the breaching force of the apparatus 30.

The scope of the present invention includes both combinations and subcombinations of the features described hereinabove as well as modifications and variations thereof which would occur to a person of skill in the art upon reading the foregoing description and which are not in the prior art.

What is claimed is:

1. Breaching apparatus comprising:

a housing constructed of a material that disintegrates upon explosion without significant amounts of fragments being given off; and an explosive element disposed in said housing capable of producing an explosive force sufficient for breaching a structure, wherein said housing comprises internal partitions spaced from one another, and said explosive element comprises a layer of a flexible explosive element disposed between said partitions and wrapped around at least one of said partitions.

2. The breaching apparatus according to claim 1, wherein at least one of said partitions substantially prevents adjacent windings of said explosive element from blowing up one another.

3. The breaching apparatus according to claim 1, further comprising a plurality of layers of said explosive element placed one above another.

4. The breaching apparatus according to claim 1, further comprising a detonator device placed adjacent and coplanar to said explosive element.

5. The breaching apparatus according to claim 1, wherein said housing is constructed of two halves.

6. The breaching apparatus according to claim 5, wherein said two halves are attached to one another by a press fit.

7. Breaching apparatus comprising:

a housing constructed of a material that disintegrates upon explosion without significant amounts of fragments being given off; and an explosive element disposed in said housing capable of producing an explosive force sufficient for breaching a structure, wherein said housing comprises a box-like structure with at least one hollow chamber in which said explosive element is disposed, and wherein said at least one hollow chamber is positioned closer to a first surface of said housing that is attachable to a structure to be breached than to a second surface of said housing opposite to said first surface, and wherein said explosive element comprises an elongate detonating cord operatively connected to a sleeve housing, which is connected to a detonator housing in which another explosive element is disposed.

8. Breaching apparatus comprising:

a housing constructed of a material that disintegrates upon explosion without significant amounts of fragments being given off;

an explosive element disposed in said housing capable of producing an explosive force sufficient for breaching a structure, wherein said housing comprises a box-like structure with at least one hollow chamber in which said explosive element is disposed, and a tray attached to said housing, wherein an explosive device is disposed between said tray and said housing.

* * * * *